US009478861B2

(12) United States Patent
Fonseca

(10) Patent No.: US 9,478,861 B2
(45) Date of Patent: Oct. 25, 2016

(54) DUAL-BAND MULTIPLE BEAM REFLECTOR ANTENNA FOR BROADBAND SATELLITES

(71) Applicant: Agence Spatiale Europeenne, Paris (FR)

(72) Inventor: Nelson Jorge Gonçalves Fonseca, Noordwijk (NL)

(73) Assignee: Agence Spatiale Europeene, Paris (FR)

( * ) Notice: Subject to any disclaimer, the term of this patent is extended or adjusted under 35 U.S.C. 154(b) by 70 days.

(21) Appl. No.: 14/625,889

(22) Filed: Feb. 19, 2015

(65) Prior Publication Data

US 2015/0236416 A1 Aug. 20, 2015

(30) Foreign Application Priority Data

Feb. 20, 2014 (EP) ..... 14305236

(51) Int. Cl.

*H01Q 5/30* (2015.01)
*H01Q 5/20* (2015.01)
*H01Q 19/19* (2006.01)

(52) U.S. Cl.

CPC ..... *H01Q 5/30* (2015.01); *H01Q 5/20* (2015.01); *H01Q 19/19* (2013.01); *H01Q 19/192* (2013.01)

(58) Field of Classification Search

CPC ..... H01Q 5/30; H01Q 5/20; H01Q 19/19; H01Q 19/192

See application file for complete search history.

(56) References Cited

U.S. PATENT DOCUMENTS 4,298,877 A * 11/1981 Sletten ..... H01Q 19/192 343/781 CA
4,342,036 A 7/1982 Scott et al.

(Continued)

FOREIGN PATENT DOCUMENTS

EP 0 689 264 A2 12/1995

OTHER PUBLICATIONS

European Search Report from European Patent Application No. 14305236, dated Jul. 4, 2014.

(Continued)

*Primary Examiner* — Hoang V Nguyen
*Assistant Examiner* — Michael Bouizza
(74) *Attorney, Agent, or Firm* — Alston & Bird LLP

(57) ABSTRACT

A broadband satellite antenna for producing a dual-band multiple beam coverage in transmission and reception based on an offset dual-optics configuration that includes a single main parabolic reflector, a hyperbolic sub-reflector, a first transmitting Multiple-Feed-per-Beam feed system, and a second receiving Multiple-Feed-per-Beam feed system. The sub-reflector surface is a Frequency Selective Surface configured to transmit any electromagnetic signals in the higher frequency band and to reflect any electromagnetic signals in the lower frequency band. The Multiple-Feed-per-Beam feed systems are located at the main focal point $F_{MO}$ and at the first sub-reflector real focal point $F_{Sreal}$. The eccentricity e of the hyperbolic sub-reflector depends on a ratio between a preset lower frequency $f_L$ in the lower frequency band $B_L$ and a preset higher frequency $f_H$ in the higher frequency band $B_H$. The first transmitting Multiple-Feed-per-Beam feed system and the second receiving Multiple-Feed-per-Beam feed system are geometrical scaled versions of each other.

13 Claims, 6 Drawing Sheets

(56) References Cited

U.S. PATENT DOCUMENTS

| | | | | |
|---|---|---|---|---|
| 4,476,471 | A | 10/1984 | Sato et al. | |
| 6,795,034 | B2 | 9/2004 | Lyerly et al. | |
| 7,522,116 | B2 | 4/2009 | Balling et al. | |
| 2003/0234745 | A1 * | 12/2003 | Choung ..... | H01Q 19/192 343/781 P |
| 2012/0075149 | A1 | 3/2012 | Palacin et al. | |

OTHER PUBLICATIONS

Veidt Bruce; Memo 71 Focal-Plane Array Architectures: Horn Clusters vs. Phased-Array Techniques; SKA; Feb. 28, 2006; Retrieved from the Internet: <URL:http://cira.ivec.org/kokuwiki/lib/exe/fetch.php/events/71_veidt.pdf> [retrieved on Jul. 3, 2014]; XP055126820.

Rusch Willard V T et al.; "Derivation and Application of the Equivalent Paraboloid for Classical Offset Cassegrain and Gregorian Antennas"; *IEEE Transactions on Antennas and Propagation*; vol. 38, No. 8; Aug. 1990; pp. 1141-1149; XP002726642.

Granet Christophe; "Designing Classical Offset Cassegrain or Gregorian Dual-Reflector Antennas from Combinations of Prescribed Geometric Parameters"; *IEEE Antennas and Propagation Magazine*; vol. 44, No. 3; Jun. 1, 2002; pp. 114-123; XP011092581.

Comtesse L E et al.; "Frequency Selective Surfaces in Dual and Triple Band Offset Reflector Antennas"; *Microwave Conference*; 1987; 17$^{th}$ European, Sep. 7, 1987; pp. 208-213; XP031602956.

Mizugutch, Y. et al.; "Offset Dual Reflector Antenna"; Antennas and Propagation Society International Symposium; vol. 14; pp. 2-5; 1976.

Sudhakar K Rao; "Parametric Design and Analysis of Multiple-Beam Reflector Antennas for Satellite Communications"; *IEEE Antennas and Propagation Magazine*; vol. 45, No. 4; pp. 26-34; Aug. 2003.

Sudhakar K Rao; "Dual-Band Multiple Bean Antenna System for Satellite Communications"; IEEE AP-S International Symposium; vol. 3A; pp. 359-362; 2005.

Schneider Michael et al.; "The multiple spot beam antenna project 'Medusa'," *3$^{rd}$ European Conference on Antennas and Propagation* (EuCAP), pp. 726-729, 2009.

* cited by examiner

DUAL-BAND MULTIPLE BEAM REFLECTOR ANTENNA FOR BROADBAND SATELLITES

FIELD OF THE INVENTION

The invention relates to a dual-band multiple beam reflector antenna for broadband communication satellites configured to provide a dual-band multiple beam coverage made of a transmit multiple beam coverage within a first transmitting frequency band (Tx) and a receive multiple beam coverage within a second receiving frequency band (Rx).

BACKGROUND

The current trend in satellite communications is to implement multiple beam coverage of congruent narrow spot beams, as it is already the case at Ka-band for current broadband applications. Investigations are on-going to extend the concept to other frequency bands and applications, such as C- and Ku-band.

Multiple beam coverage is known to provide better antenna gain for a given antenna aperture size and significantly increases the communication satellite-based system capacity by frequency spectrum re-use on non-adjacent spot beams. Frequency re-use schemes implemented in satellite-based communication systems use elementary sets or patterns of spot beams, corresponding to the so-called cells commonly used in ground cellular communication networks. Usually a pattern of four spot beams, also referred to as a four-colour scheme, shares the full available spectrum (other patterns including 3 or 7 spot beams may also be considered). The elementary set of spot beams is duplicated or repeated over the entire coverage in such a way that adjacent beams do not use the same combination of carrier frequency and polarisation, so as to minimise the interference between a desired signal within a spot beam and unwanted signals from the adjacent spot beams. The level of interference is usually evaluated with the carrier over interferers ratio (C/I). As an example, a typical four-colour re-use scheme implements frequency and polarisation diversity, i.e. any two adjacent beams within the satellite coverage may either use a different frequency sub-band and/or a different polarisation. The main challenge at antenna level is to produce all the beams with an acceptable cross-over level (typically 3 to 5 dB below the peak gain) in order to ensure high radio frequency (RF) performance over the full coverage.

A conventional reflector antenna configuration wherein feeds are designed to provide proper illumination of the main reflector typically results in poor cross-over level between the beams generated by adjacent feeds (10 dB or more).

This limitation is usually overcome by using 3 or 4 single-feed-per-beam (SFB) single-reflector antennas to produce all the beams in the desired multiple beam coverage. A first configuration, implementing such a solution at Ka-band, that uses eight SFB reflector antennas to produce a dual-band (Tx/Rx) multiple beam coverage is described in the paper of Sudhakar K. Rao, entitled "Parametric Design and Analysis of Multiple-Beam Reflector Antennas for Satellite communications," IEEE Antennas and Propagation Magazine, Vol. 45, No. 4, pp. 26-34, August 2003. This antenna farm configuration, implemented on the Anik-F2 satellite, comprises four SFB reflectors (Tx) operating in a transmitting mode and four SFB reflectors (Rx) operating in a receiving mode. The reflector apertures have different dimensions in the transmitting mode (Tx) and in the receiving mode (Rx) in order to ensure congruence of the beams and similar cross-over levels regardless of the operating bands. Such a configuration is obviously very restrictive in terms of accommodation within the fairing of the launch vehicle due to the high number of apertures required.

A solution to reduce the number of apertures has been to use dual-band (Tx/Rx) SFB reflector antennas as described in the paper of Sudhakar Rao et al., entitled "Dual-band multiple beam antenna system for satellite communications," IEEE AP-S International Symposium, Vol. 3A, pp. 359-362, 2005 or as implemented on a few in-flight state-of-the-art commercial satellites as Ka-Sat and Viasat-1. However, using the same reflector aperture at two different frequency bands, corresponding respectively to the transmit (Tx) coverage and the receive (Rx) coverage requires to shape the reflector so as to broaden the receiving beams at the higher frequency band and to ensure that the cross-over level remains similar to the one in the transmit coverage.

Besides, as current beam sizes are in the range of 0.4 to 0.7 degree at Ka-band, reflector apertures in the range of two meters and more are required, which results in a satellite accommodation with two reflector antennas per lateral face and leaves very limited space for other missions.

To further increase the satellite capacity, smaller spot beams are being considered for next generations of High Throughput Satellites (HTS) thus requiring even larger reflector apertures. This constraint combined with the operator's need to allocate more missions on a satellite to increase their revenue calls for antenna farms with a reduced number of apertures while maintaining high level of performance. On-going developments include solutions with a reduced number of apertures to produce a full dual-band multiple beam coverage.

One solution is to use advanced feed systems based on Multiple-Feed-per-Beam (MFB) configurations as described in the paper of Michael Schneider et al., entitled "The multiple spot beam antenna project 'Medusa'," 3rd European Conference on Antennas and Propagation (EuCAP), pp. 726-729, 2009. Such a solution requires a focal array with more feeds than beams, typically seven feeds used per beam, with a certain level of overlap between adjacent clusters of feeds to generate proper cross-over between the beams. A Beam Forming Network (BFN) is used to connect a given cluster to its beam port, waveguide technology being usually preferred at Ka-band. However, due to the bandwidth limitations of the BFN, the full coverage needs to be produced with two separate apertures, one aperture for the transmit (Tx) coverage and one aperture for the receive (Rx) coverage.

Other solutions using only one aperture are also proposed.

A first category of solutions as described in the U.S. Pat. No. 7,522,116 B2 uses an over-sized reflector configuration, which may still lead to accommodation issues, or requires the use of advanced and complex reflector technology, e.g. deployable mesh reflectors, for smaller spot beam sizes.

A second category of solutions as for example the multi-beam communication satellite antenna described in the patent application US 2012/0075149 A1 is based on a normal-size reflector configuration but with degraded performance. Such satellite antenna leads to very high spill-over losses in the range of 3 to 10 dB, which significantly affects the antenna gain and overall system performance. These high spill-over losses are related to a poor illumination of the reflector which also produces higher side lobe levels, and as a consequence degraded C/I performance.

U.S. Pat. No. 4,342,036 discloses a broadband communication satellite antenna with a triple band multiple beam coverage that uses only a single main reflector and two sub-reflectors with frequency selective surfaces. The disclosed antenna system does not anticipate specific constraints associated with dual-band (transmit/receive) missions and the optical system is based on a Newtonian model (flat sub-reflector).

SUMMARY

It is an aim of the present invention to provide a broadband communication satellite antenna that has a full dual-band multiple beam coverage, using a main reflector, a sub-reflector with a frequency selective surface and separate Multiple-Feed-per-Beam feed systems, with which the design process of the feed systems can be simplified and optimized in their respective operating bands.

It is an aim of the present invention to provide a broadband communication satellite antenna that has a full dual-band multiple beam coverage, that uses only a single main reflector with a size fulfilling the mating limitation within a satellite intended to enter a fairing of current launch vehicles, while maintaining high RF performance, for example an efficiency higher than 50% and a C/I better than 15 dB over the full transmit coverage and the full receive coverage.

These and other aims have been achieved according to the invention as defined in the claims.

The invention relates to a broadband communication satellite antenna for producing a dual-band multiple beam coverage made of a transmit multiple beam coverage operating in a first transmitting frequency band $B_{Tx}$ and a receive multiple beam coverage operating in a second receiving frequency band $B_{Rx}$, the first transmitting frequency band $B_{Tx}$ and the second receiving frequency band $B_{Rx}$ not overlapping, the communication satellite antenna being based on an offset dual-optics configuration and comprising: a single main parabolic reflector having a main optical center O, a main focal point $F_{MO}$ and a main projected aperture diameter D; a sub-reflector, hyperbolic with a finite eccentricity e, that has a sub-reflector optical centre $F_{SO}$, a first sub-reflector real focal point $F_{Sreal}$ and a second sub-reflector virtual focal point $F_{Svirtual}$; a first transmitting Multiple-Feed-per-Beam feed system configured to generate the first transmit coverage and to illuminate the main reflector through the sub-reflector; and a second receiving Multiple-Feed-per-Beam feed system configured to generate the second receive coverage and to be illuminated by the main reflector through the sub-reflector.

The sub-reflector is a Frequency Selective Surface configured to transmit any electromagnetic signals in the higher frequency band $B_H$ among the first transmitting and the second receiving frequency bands, and to reflect any electromagnetic signals in the lower frequency band $B_L$ among the first transmitting and the second receiving frequency bands.

The sub-reflector optical centre $F_{SO}$ is located between and aligned with the main reflector optical centre O and the main reflector focal point $F_{MO}$.

The Multiple-Feed-per-Beam feed system among the first transmitting and second receiving Multiple-Feed-per-Beam feed systems that operates in the higher frequency band $B_H$ is located at the main focal point $F_{MO}$, while the remaining Multiple-Feed-per-Beam feed system that operates in the lower frequency band is located at the first sub-reflector real focal point $F_{Sreal}$.

The eccentricity e of the hyperbolic sub-reflector depends on a ratio between a preset lower frequency $f_L$ in the lower band $B_L$ and a preset higher frequency $f_H$ in the higher band $B_H$, and is determined according to the implicit equation:

$$\frac{f_H}{f_L} = \frac{|e^2 - 1|}{(e^2 + 1) - 2e\cos\beta},$$

wherein β is a predetermined tilt angle between the axe of symmetry of the parabola defined by the main reflector and the axe of symmetry of the hyperbola defined by the sub-reflector. The first transmitting Multiple-Feed-per-Beam feed system and the second receiving Multiple-Feed-per-Beam feed system are preferably geometrical scaled versions of each other.

According to specific embodiments, the broadband communication satellite antenna comprises one or more of the following features:

- the antenna has a Cassegrain dual-optics configuration; the second sub-reflector virtual focal point $F_{Svirtual}$ and the main focal point $F_{MO}$ coincide; and the Multiple-Feed-per-Beam feed system among the first transmitting and second receiving Multiple-Feed-per-Beam feed systems that operates in the higher frequency band is located at the second sub-reflector virtual focal point $F_{Svirtual}$ that is confocal with the main focal point $F_{MO}$;
- the Frequency Selective Surface of the sub-reflector has an eccentricity e higher than 3, preferably ranging from 4 to 10, and more preferably ranging from 4 to 5;
- the equivalent focal length $F_{eq}$ of the dual-optics configuration of the antenna is related to the focal length $F_M$ of the main parabolic reflector according to the equation:

$$F_{eq} = F_M \frac{|e^2 - 1|}{(e^2 + 1) - 2e\cos\beta};$$

- the tilt angle β is set to avoid the blockage effects between the main reflector and the sub-reflector, and also to comply with the Mizugutch condition providing low cross polarization;
- the lower frequency $f_L$ and the higher frequency $f_H$ are respectively a frequency in the lower frequency band $B_L$ and a frequency in a the higher frequency band $B_H$, preferably the centre frequency of the lower frequency band $B_L$ and the centre frequency of the higher frequency band $B_H$;
- either the second receiving Multiple-Feed-per-Beam feed system operates in the higher frequency band $B_H$ as the second receiving frequency band $B_{Rx}$ and is located at the second sub-reflector virtual focal point $F_{Svirtual}$, while the first transmitting Multiple-Feed-per-Beam feed system operates in the lower frequency band $B_L$ as the first transmitting frequency band $B_{Tx}$ and is located at the first sub-reflector real focal point $F_{Sreal}$, or the first transmitting Multiple-Feed-per-Beam feed system operates in the higher frequency band $B_H$ as the first transmitting frequency band $B_{Tx}$ and is located at the second sub-reflector virtual focal point $F_{Svirtual}$, while the second receiving Multiple-Feed-per-Beam feed system operates in the lower frequency band $B_L$ as the second receiving frequency band $B_{Rx}$ and is located at the first sub-reflector real focal point $F_{Sreal}$;

the first transmitting frequency band and the second receiving frequency band are two separate sub-bands in Ka-band, the main parabolic reflector has a projected main aperture diameter of 2 m, a clearance of 0.5 m and a main focal length of 3 m, the first transmitting centre frequency and the second receiving centre frequency are respectively equal to 18.95 and 28.75 GHz, the eccentricity e is equal to 4.4, and the β angle is equal to 20 degrees, the first transmitting feed system and the second receiving feed system are configured to generate a transmit multiple beam coverage and a receive multiple beam coverage, the transmit multiple beam coverage and the receive multiple beam coverage being composed respectively of 19 beams with a beam size of 0.5 degrees, that are mutually congruent;

the first transmitting frequency band and the second receiving frequency band are two separate sub-bands of a same third band, the third band being comprised within the family of L-band, S-band, C-band, X-band, Ku-band, Ka-band and Q/V-band;

the number of beams is comprised between 10 and 60.

BRIEF DESCRIPTION OF THE SEVERAL VIEWS OF THE DRAWINGS

The invention will be better understood from a reading of the description of several embodiments below, given purely by way of example and with reference to the drawings, in which.

DETAILED DESCRIPTION

Figure 1:
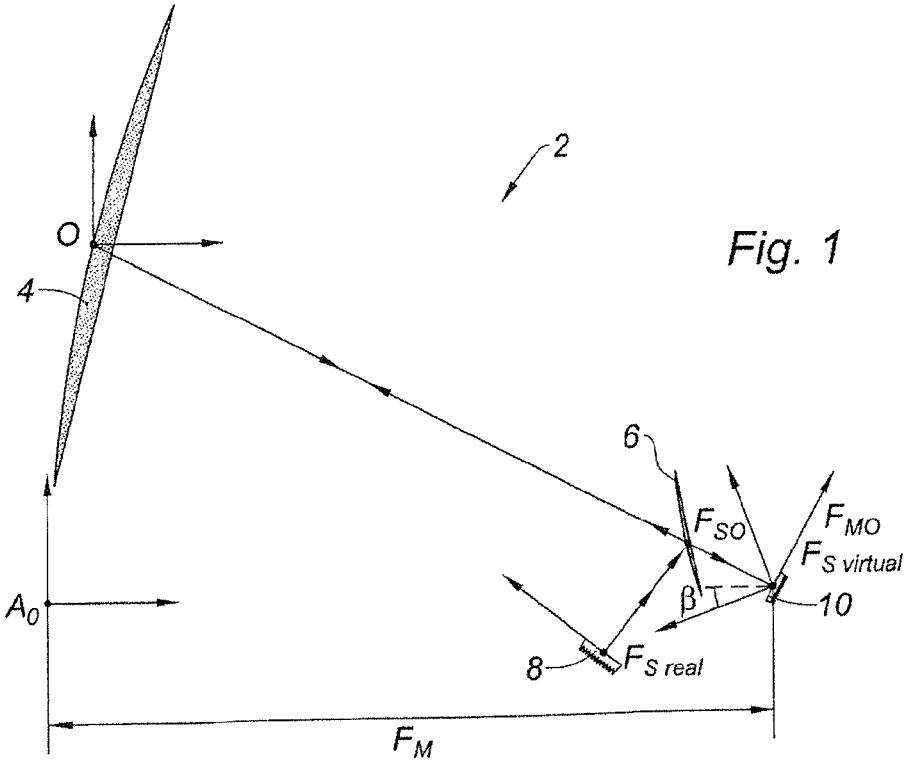
FIG. 1 is a view of a dual-band satellite communication antenna according to a first embodiment of the invention.
Figure 2:
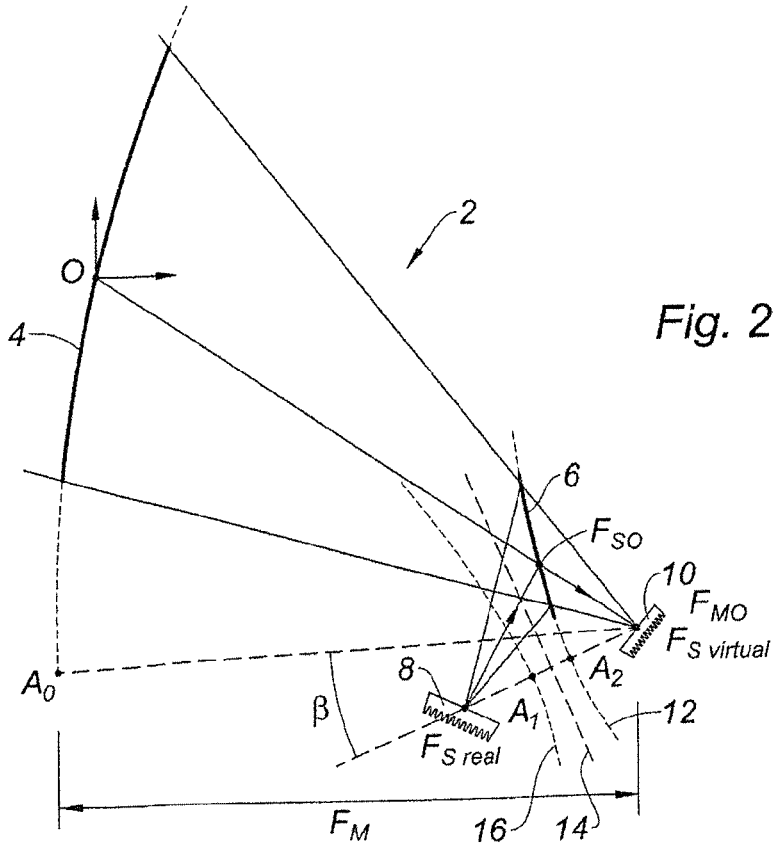
FIG. 2 is a view of the communication antenna as described in FIG. 1 wherein the geometry of the sub-reflector is more detailed.

According to FIGS. 1-2 and a first embodiment of the invention, a broadband communication satellite antenna 2, for producing a dual-band multiple beam coverage, made of a transmit multiple beam coverage operating in a first transmitting frequency band $B_{Tx}$ and of a receive multiple beam coverage operating in a second receiving frequency band $B_R$, is based on an offset dual-optics configuration.

The first transmitting frequency band $B_{Tx}$ and the second receiving frequency band $B_{Rx}$ are separate or in other terms do not overlap. These bands are two separate sub-bands of a same third band, here the Ka-band.

Generally in communication satellite applications, the third band is comprised within the family of L-band, S-band, C-band, X-band, Ku-band, Ka-band and Q/V-band.

The broadband communication satellite antenna 2 comprises a single main parabolic reflector 4, a hyperbolic sub-reflector 6, a first transmitting Multiple-Feed-per-Beam (MFB) feed system 8 configured to generate the first transmit coverage and to illuminate the sub-reflector 6, and a second receiving Multiple-Feed-per-Beam (MFB) feed system 10 configured to generate the second receive coverage and to be illuminated by the main reflector 4 through the sub-reflector 6.

The surface of the main parabolic reflector 4 is a portion of a paraboloid. The main parabolic reflector 4 has a main optical center O, a main focal point $F_{MO}$, a paraboloid main apex point $A_0$ and a main projected aperture diameter D, the distance between the main apex point $A_0$ and the main focal point $F_{MO}$ defining the main focal length $F_M$ of the main reflector 4.

The hyperbolic sub-reflector 6 is a Frequency Selective Surface (FSS) configured to transmit any electromagnetic signals in the second receiving frequency band and to reflect any electromagnetic signals in the first transmitting frequency band.

It should be noticed that antenna configurations with frequency selective sub-reflectors are reported in the U.S. Pat. Nos. 4,476,471 and 6,795,034 B2, but their use is limited to single beam at each frequency. The document U.S. Pat. No. 4,476,471 considers several antenna geometries, and describes antenna apparatus that includes a frequency separator having wide band transmission or reflection characteristics. The described geometries include offset geometries with flat FSS and centred geometries with curved FSS. The document U.S. Pat. No. 6,795,034 B2 describes a Gregorian geometry, i.e. including an elliptical sub-reflector. Extending these concepts to a multiple beam coverage is not obvious as the use of a same reflector to produce multiple beam coverage using MFB feed systems brings specific issues to ensure congruent coverage in the transmitting Tx mode and in the receiving Rx mode and optimal RF performance that are not studied in these prior art documents.

According to FIG. 2 wherein the view of the sub-reflector has been enlarged, the surface of the hyperbolic sub-reflector 6 is a portion of a convex hyperboloid 12 shown in a first dotted line, the symmetric shape around a symmetry axe 14 of a concave hyperboloid 16 corresponding to the convex hyperboloid 12 being shown in a second dotted line.

The hyperbolic sub-reflector 6 has a sub-reflector optical centre $F_{SO}$ that is located between and aligned with the main reflector optical centre O and the main reflector focal point $F_{MO}$.

The hyperbolic sub-reflector 6 has also a first sub-reflector real focal point and a second sub-reflector virtual focal point designated respectively by $F_{Sreal}$ by $F_{Svirtual}$.

The apex point of the concave hyperboloid 16 and the apex point of the convex hyperboloid 12 are respectively designated by $A_1$ and $A_2$.

The eccentricity of the sub-reflector 6 is a parameter e defined as the ratio between the interfocal distance $F_{Sreal}F_{Svirtual}$ and the distance $A_1A_2$ separating the hyperbola apex points $A_1$ and $A_2$.

Here, in this example the second receiving frequency band $B_{Rx}$ is a higher frequency band $B_H$ in respect of the first transmitting frequency band $B_{Tx}$ that is a lower frequency band $B_L$.

The first transmitting Multiple-Feed-per-Beam (MFB) feed system 8 is located at the first sub-reflector real focal point $F_{Sreal}$.

The second receiving Multiple-Feed-per-Beam (MFB) feed system 10 is located at the second sub-reflector virtual focal point $F_{Svirtual}$ that coincides with the main focal point $F_{OM}$ of the main reflector 4.

A lower frequency $f_L$ in the lower frequency band $B_L$ (here $B_{Tx}$) and a higher frequency $f_H$ in the higher frequency band $B_H$ (here $B_{Rx}$) are selected. For example the lower frequency $f_L$ and the higher frequency $f_H$ are respectively the centre frequency of the lower frequency band $B_L$ (here $B_{Tx}$) and the centre frequency of the higher frequency band $B_H$ (here $B_{Rx}$).

The ratio r between the main focal length $F_M$ of the main reflector 4 and an equivalent focal length $F_{eq}$ of the dual-optics configuration of the antenna 2 is equal to the ratio between the lower frequency $f_L$ and the higher frequency $f_H$ according to the equation $$r = \frac{f_L}{f_H} = \frac{F_M}{F_{eq}}, \quad \text{(equation 1)}$$

wherein the equivalent focal length $F_{eq}$ of the dual-optics configuration of the antenna 2 is defined in the paper of W. Rusch et al., entitled "Derivation and application of the equivalent paraboloid for the classical offset Cassegrain and Gregorian antennas" and published in IEEE Transactions on antennas and propagation, Vol. 38, no 8, August 1990, pp. 1141-1149, by the equation:

$$F_{eq} = F_M \frac{|e^2 - 1|}{(e^2 + 1) - 2e\cos\beta}; \quad \text{(equation 2)}$$

From the equations (1) and (2) it follows that the eccentricity e depends on the ratio r between the lower frequency $f_L$ and the higher frequency $f_H$ and is determined according to the implicit equation:

$$\frac{1}{r} = \frac{f_H}{f_L} = \frac{|e^2 - 1|}{(e^2 + 1) - 2e\cos\beta}, \quad \text{(equation 3)}$$

where β is a predetermined tilt angle between the axe of symmetry of the parabola defined by the main reflector 4 and the axe of symmetry of the hyperbola defined by the sub-reflector 6.

The predetermined tilt angle β is the angle defined between the axe joining the main focal point $F_{MO}$ to the parabola apex $A_0$ to the axe joining the convex apex point $A_2$ to the concave apex point $A_1$.

In practice, the tilt angle β will be set so as to avoid blockage effects between the main and sub-reflectors and also comply with the Mizugutch condition providing low cross-polarization, as defined in Y. Mizugutch et al., "Offset dual reflector antenna," Antennas and Propagation Society International Symposium, vol. 14, pp. 2-5, 1976.

Figure 3:
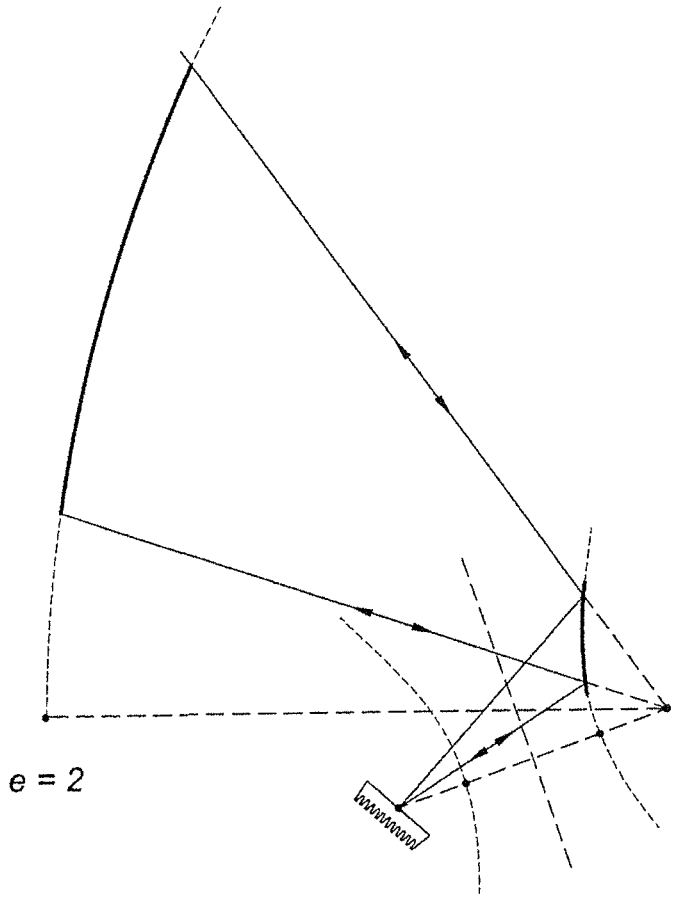
FIG. 3 is a view of a conventional Cassegrain antenna with the eccentricity of the sub-reflector equal to 2.

Such a design leads to Cassegrain configurations having hyperbolic sub-reflectors that have unusually high eccentricity in respect of the conventional designs. Designs reported in the literature have an eccentricity in the range of 1 to 3 approximately, as exemplary shown in the FIG. 3 (case of an eccentricity equal to 2) or described in the paper of Christophe Granet, entitled "Designing classical offset Cassegrain or Gregorian dual-reflector antennas from combinations of prescribed geometric parameters," and published in IEEE Antennas and Propagation Magazine, Vol. 44, No. 3, pp. 114-123, June 2002. Values even lower are reported in this paper owing to the wide spread use of centred configurations with one of the two feeds being located at the vertex of the parabolic main reflector.

According to the invention design, the sub-reflector has an eccentricity e higher than 3, preferably ranging from 4 to 10, and more preferably ranging from 4 to 5.

As an example, for broadband satellite applications operating at Ka-band, the typical Tx frequency band is from 17.7 to 20.2 GHz and the typical Rx frequency band is from 27.5 to 30 GHz. Using these bands of frequencies to design a Cassegrain geometry according to the invention design rules leads to an eccentricity typically between 4 and 5. The shape of the obtained sub-reflector 6 is quite close to a flat surface while still being hyperbolic. Such a shape is attractive in terms of mechanical manufacturing simplicity and achievable performance. For instance, an almost flat surface is much easier to manufacture than a highly curved one, while a slightly shaped surface is expected to be stiffer than a flat one.

When the communication antenna 2 operates, the Frequency Selective Surface of the sub-reflector 6 reflects the lower frequency band, here the transmitting Tx frequency band, of the transmitted signals generated by the first transmitting MFB system 8, while being transparent at the higher frequency band, here the receiving Rx frequency band, to allow the received signals reflected by the main reflector 4 to be received by the second receiving MFB system 10 located at the main focal point $F_{MO}$.

Figure 4:
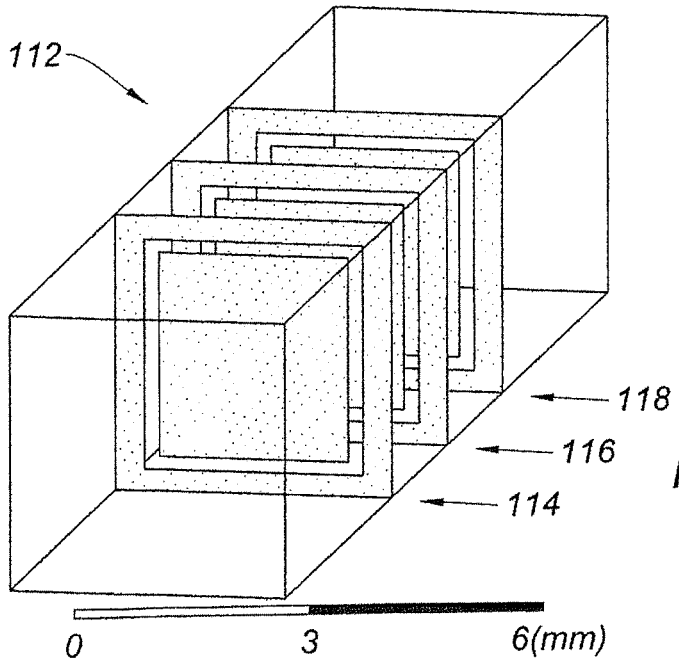
FIG. 4 is a view of an exemplary elementary resonant printed pattern used on the sub-reflector described in FIGS. 1 and 2.

Such an antenna 2 requires a Frequency Selective Surface with a band-pass or a high-pass filtering profile having a ratio of 1:1.3 between the highest reflected frequency (in the Tx band) and the lowest transmitted frequency (in the Rx band). Several designs of FSS compatible with these requirements can be found in the literature, either based on resonant printed patterns or waveguide structures. An example of an elementary resonant printed pattern 112 repeated periodically over the Frequency Selective Surface is shown in FIG. 4. According to the FIG. 4, the elementary resonant printed pattern 112 is based on a three-layer square loop designed to operate at Ka-band. Three layers 114, 116, 118 of elementary square loops having the same lattice or geometrical period but slightly different loops' dimensions are printed on a thin supporting material such as kapton and are separated by a material with preferably very low dielectric constant such as Kevlar honeycomb or foam.

The arrangement of the feed systems as described in the FIG. 1 results in a compact dual-optics geometry as the focal length $F_M$ of the main reflector 4 is set by the higher frequency band. The obtained reduction in focal length is about 30% in comparison to a conventional offset configuration using a flat FSS sub-reflector in which the focal length of the main reflector would be set by the lower frequency band.

Another attractive feature and improvement brought by the antenna geometry as described in FIGS. 1 and 2 concerns the design of the MFB feed systems 8 and 10. It is well known that typical multiple-feed-per-beam feed systems overlapping clusters of 7 feeds use feeds with an aperture diameter in the range of 0.7 to 2 wavelengths. Feeds in the lower diameter range tend to have poor efficiency while feeds in the higher diameter range tend to produce degraded main reflector illumination. The optimum value is around 1.1-1.3 wavelengths.

With the antenna configuration as described in FIGS. 1 and 2, it is possible to implement the optimum feed diameter in the two bands and still maintain congruent coverage. The angular distance between two beams in multiple beam coverage is related to the physical distance normalised to the focal length between the two corresponding feeds in the focal plan or the phase centres of the two corresponding clusters in the case of MFB feed systems. Since the focal lengths seen by the two feed systems are scaled to the ratio of the wavelengths, the feed systems themselves are also scaled versions of each other. This ensures congruent coverage in transmitting Tx mode and receiving Rx mode with optimum feed system designs.

As an additional advantage of the antenna configuration of FIGS. 1 and 2, the numerous degrees of freedom left in the design may be used to further optimise several performance features, namely the amplitude and phase distributions in the MFB feed systems 8 and 10 as well as the design of the selective frequency elements of the FSS which may be tuned to cope with the variation of the incidence angle.

The only drawback of the proposed configuration in FIGS. 1 and 2 is the well-known drawback of any dual-optics configuration, which is that scanning performance are degraded in comparison with a single-offset reflector geometry.

For this reason, the antenna configuration of the FIGS. 1 and 2 is more dedicated to mission scenarios having a limited number of beams in the range of 10 to 60, even if this number depends lastly on the overall geometry of the system. Missions to be implemented as secondary payloads or on smaller platforms will be particularly suited to benefit from the compact geometry of the proposed communication antenna described in FIG. 1, since the limited number of beams is inherent to the mission as a secondary payload.

The RF performance of an exemplary communication antenna of FIGS. 1 and 2 operating at Ka-band have been validated by simulation. The considered coverage of the antenna is composed of 19 beams with a beam size of 0.5 degrees (triple cross-over point), which corresponds to a beam-to-beam angular distance of 0.43 degrees. The main parabolic reflector 4 has been defined with a projected aperture diameter of 2 m, a clearance of 0.5 m and a main focal length of 3 m. The centre frequencies of the transmitting Tx and receiving Rx bands, 18.95 and 28.75 GHz respectively, were used to define the eccentricity of the sub-reflector according to the formula:

$$\frac{f_{Rx}}{f_{Tx}} = \frac{|e^2 - 1|}{(e^2 + 1) - 2e\cos\beta} \quad \text{(equation 4)}$$

where $f_{Rx}$ is the frequency in the higher frequency band $B_H$, $f_{Tx}$ is the frequency in the lower frequency band $B_L$, e is the eccentricity of the sub-reflector 6, and β is the angle between the axes of symmetry of the parabola defined by the main reflector 4 and of the hyperbola defined by the sub-reflector 6.

With β set to 20 degrees, the eccentricity e is equal to 4.4.

Assuming a feed cluster of 7 feeds per beam, the selected focal length of the main reflector in combination with the selected beam-to-beam angular distance leads to a feed diameter of about 1.25 wavelengths using the formula:

$$d = F \tan\theta \quad \text{(equation 5)}$$

where F is the focal length of the main reflector,

θ is the beam-to-beam angular distance and d is the distance between the phase centres of two adjacent feed clusters.

Figure 5:
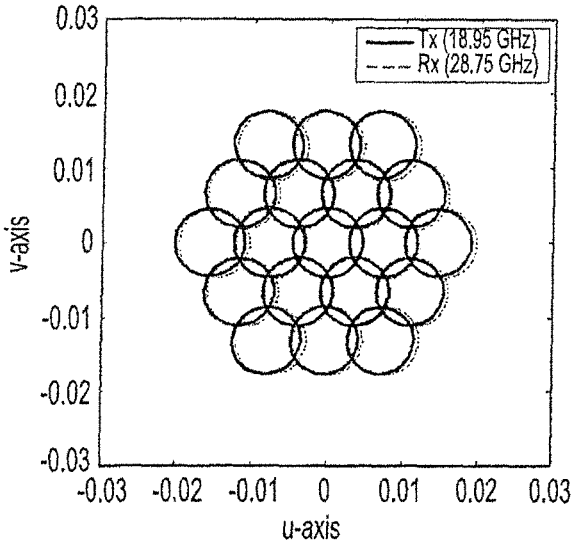
FIG. 5 illustrates the contour plots of the beams in the transmitting and receiving bands (Tx/Rx) at Ka-band for an exemplary dimensioning of the communication antenna in FIGS. 1 and 2.

According to the FIG. 5, contoured plots of the beams have been computed at 18.95 and 28.75 GHz with a contour level set at 46 dBi, and displayed. This contour level is approximately the worst case directivity over the 19 beams coverage, as it almost corresponds to the triple-cross-over point. The coverage in the transmitting Tx mode (thick continuous lines) and the coverage in the receiving Rx mode (thin dashed lines) prove to be in excellent agreement with very similar worst case directivity performance.

Figure 6A:
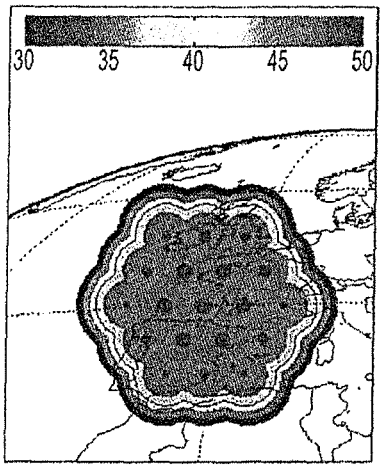
FIGS. 6A and 6B are views of the aggregate directivity of the antenna respectively in a transmit coverage and a receive coverage under the same conditions as for the FIG. 5.
Figure 6B:
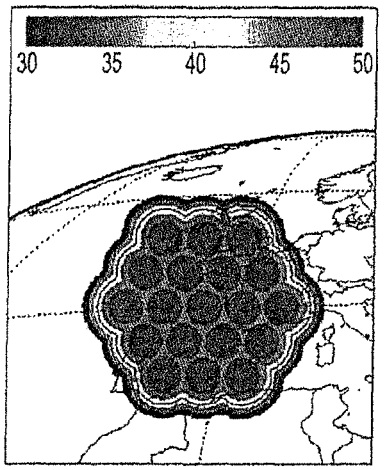

The FIGS. 6A and 6B provide respectively the aggregate directivity in a transmitting Tx coverage and in a receiving Rx coverage, the coverage including as footprint on the Earth over the Great Britain, France, Spain and Portugal.

As expected, the maximum directivity is slightly higher in the receiving Rx coverage than in the transmitting Tx coverage as the same aperture is shared in the two bands. This indicates that a slight beam shaping could be implemented to better distribute the power in the receiving Rx coverage while maintaining limited impact in the transmitting Tx coverage, as usually done in dual-band SFB configurations.

Figure 7A:
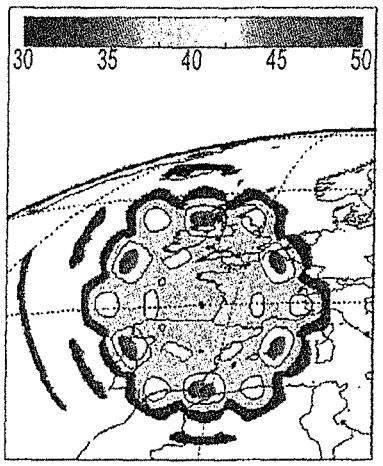
FIGS. 7A and 7B are views of the C/I performance over the same respective transmit coverage and receive coverage of the FIGS. 6A, 6B under the same antenna configuration by using a 4-colour reuse scheme.
Figure 7B:
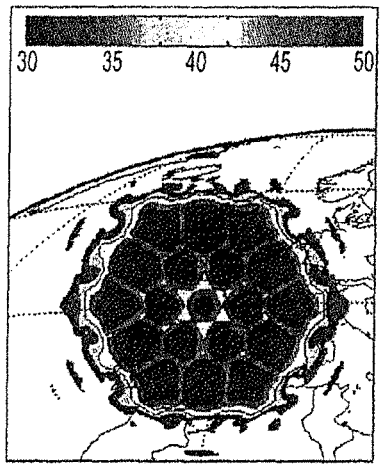

Assuming a 4-colour re-use scheme, the signal over interference ratio C/I has been computed and is reported in the FIG. 7A and FIG. 7B for respectively the transmit Tx coverage and the receive Rx coverage. A worst case of about 15 dB is found for the C/I over the transmit Tx coverage. These performance were obtained assuming a perfect sub-reflector, i.e. fully transparent at the receiving Rx frequency and fully reflective at the transmitting Tx frequency.

In order to assess the impact of a preliminary Frequency Selective Surface design on the antenna directivity, when considering the challenging small ratio of 1:1.36 between 20.2 GHz (highest reflected frequency) and 27.5 GHz (lowest transmitted frequency), simulations have been performed by using the exemplary structure of the FSS elements described in FIG. 4.

Figure 8:
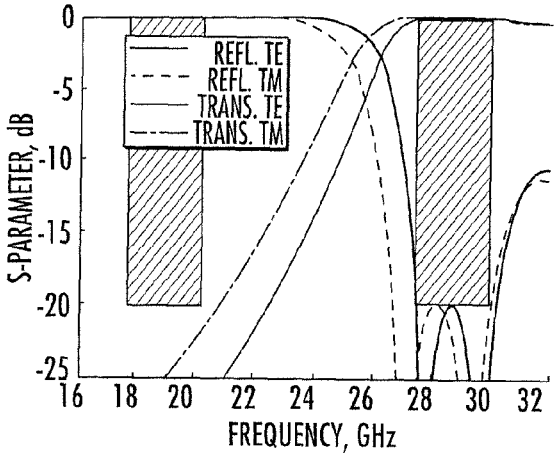
FIG. 8 illustrates plots of the S-parameters evolution versus frequency of the FSS elementary resonant structure of FIG. 4 tuned to provide optimal response for an EM field incidence angle of 45 degrees.

In the FIG. 8, simulation results are reported that display for both TE and TM plane waves the S-parameters evolution versus frequency of the three-layer square-slots FSS design of FIG. 4, optimised at an incident angle of 45 degrees, which is approximately the angular inclination of the sub-reflector with respect to the feed system (focal) plane. This indicates that the impact of the FSS on the antenna directivity should be lower than 0.2 dB.

Figure 9A:
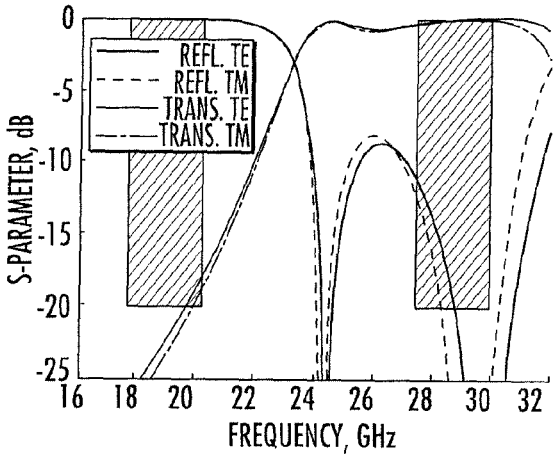
FIGS. 9A, 9B, 9C are electrical performance in terms of S-parameters evolution versus frequency of the optimized FSS elementary resonant structure of FIG. 4 tuned to provide good performance over a broad range of incidence angles, results reported being for incidence angles of 30, 45 and 60 degrees respectively.
Figure 9B:
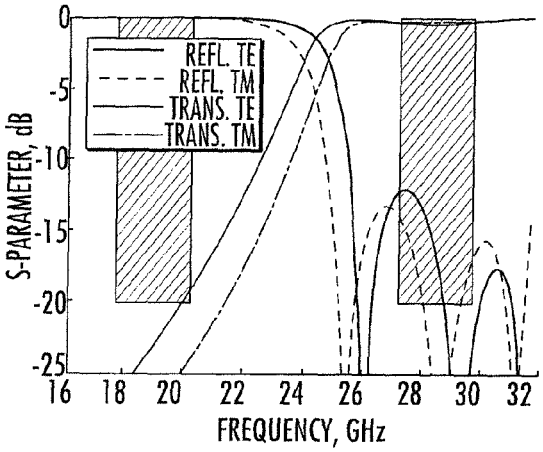
Figure 9C:
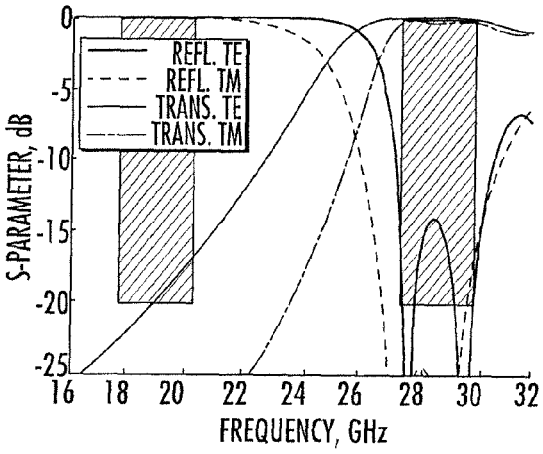

However, the performance of this optimal design tends to degrade with the incidence angle. Considering the angular field of view of the sub-reflector as seen from the focal points, the design was further optimised to enable good performance for incidence angles between 30 and 60 degrees. Simulations results are given in FIG. 9A, 9B, 9C for respectively 30, 45 and 60 degrees. With this design, the worst case degradation induced by the FSS remains below 0.4 dB in the receiving Rx band and below 0.1 dB in the transmitting Tx band. Although this preliminary design assumes a periodic and flat FSS, it gives the confidence that an optimised FSS with an almost flat hyperbolic surface should have limited impact on the overall antenna RF performance.

Figure 10:
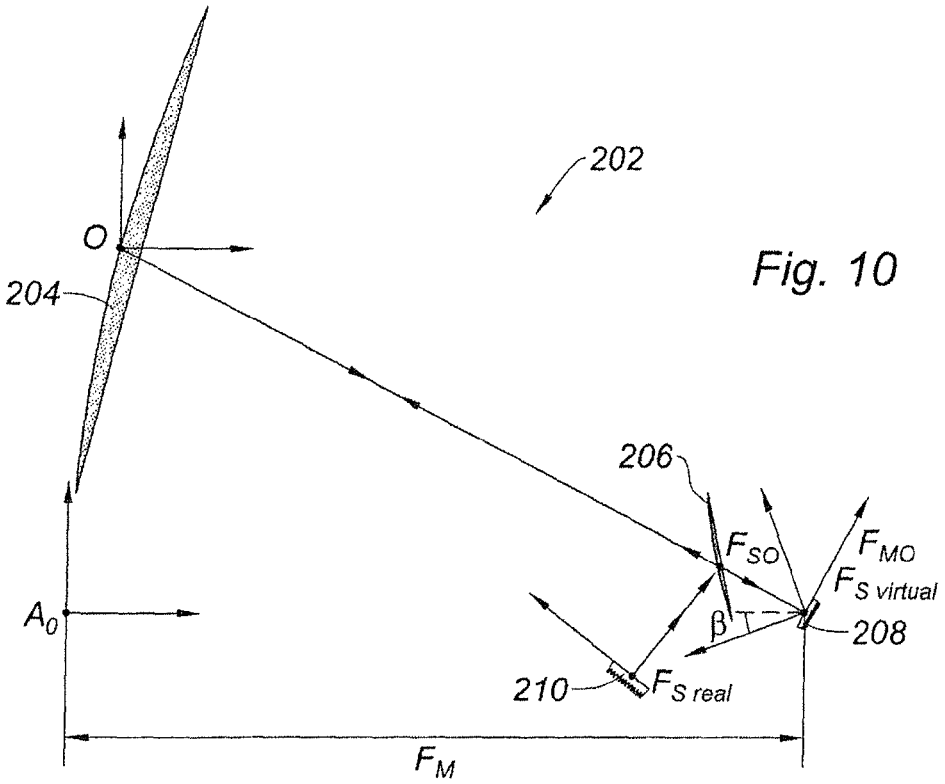
FIG. 10 is a view of a dual-band satellite communication antenna according to a second embodiment of the invention.
Figure 11:
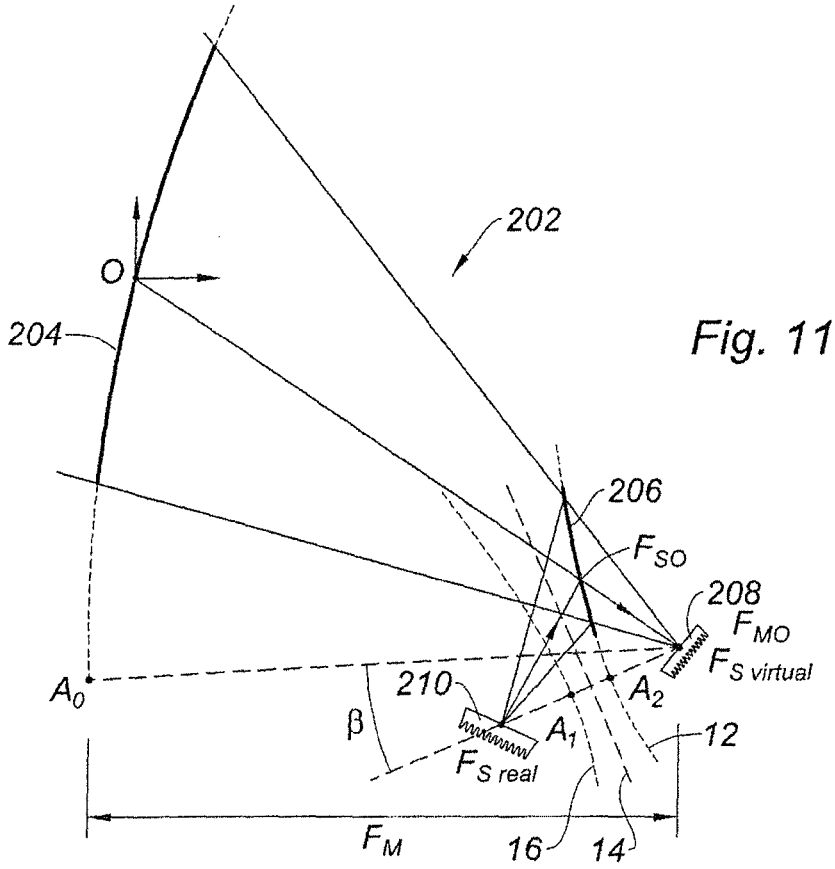
FIG. 11 is a view of the communication antenna as described in FIG. 10 wherein the geometry of the sub-reflector is more detailed.

According to the FIGS. 10 and 11, and a second embodiment of the invention, a broadband communication satellite antenna 202, for producing a dual-band multiple beam coverage, made of a transmit multiple beam coverage operating in a first transmitting frequency band $B_{Tx}$ and of a receive multiple beam coverage operating in a second receiving frequency band $B_{Rx}$, is based on an offset dual-optics configuration.

Like the antenna 2 of FIGS. 1 and 2, the first transmitting frequency band $B_{Tx}$ and the second receiving frequency band $B_{Rx}$ are separate or in other terms do not overlap. These bands are two separate sub-bands of a same third band, here the Ka-band. As a variant, the third band may be also L-band, S-band, C-band, X-band, Ku-band or Q/V band.

The broadband communication satellite antenna 202 comprises a single main parabolic reflector 204, a hyperbolic sub-reflector 206, a first transmitting Multiple-Feed-per-Beam (MFB) feed system 208 configured to generate the first transmit coverage and to illuminate the main reflector 204 through the sub-reflector 206, and a second receiving Multiple-Feed-per-Beam (MFB) feed system 210 configured to generate the second receive coverage and to be illuminated by the sub-reflector 206.

Like the communication antenna 2 and the main parabolic reflector 4 of FIG. 1, the main parabolic reflector 204 has a main optical center O, a main focal point $F_{MO}$, a parabola main apex point $A_0$ and a main projected aperture diameter D, the distance between the main apex point $A_0$ and the main focal point $F_{MO}$ defining the main focal length $F_M$ of the main reflector 204.

Conversely to the communication antenna 2 and the hyperbolic sub-reflector 6 of FIGS. 1 and 2, the hyperbolic sub-reflector 206 is a Frequency Selective Surface (FSS) configured to transmit any electromagnetic signals in the first transmitting frequency band and to reflect any electromagnetic signals in the second receiving frequency band.

The hyperbolic sub-reflector 206 has a sub-reflector optical centre $F_{SO}$ that is located between and aligned with the main reflector optical centre O and the main reflector focal point $F_{MO}$.

Here, in this example and conversely to the communication antenna 2 of FIG. 1, the second receiving frequency band is a lower frequency band $B_L$ in respect of the first transmitting frequency band that is a higher frequency band $B_H$.

Conversely to the communication antenna 2 and the first transmitting Multiple-Feed-per-Beam (MFB) feed system 8 of FIGS. 1 and 2, the first transmitting Multiple-Feed-per-Beam (MFB) feed system 208 is located at the second sub-reflector virtual focal point $F_{Svirtual}$ that coincides with the main focal point $F_{MO}$ of the main reflector 204.

Conversely to the communication antenna 2 and the second receiving Multiple-Feed-per-Beam (MFB) feed system 10 of FIGS. 1 and 2, the second receiving Multiple-Feed-per-Beam (MFB) feed system 210 is located at the first sub-reflector real focal point $F_{Sreal}$.

A lower frequency $f_L$ in the lower frequency band $B_L$ (here $B_{Rx}$) and a higher frequency $f_H$ in the higher frequency band $B_H$ (here $B_{Tx}$) are selected. For example the lower frequency $f_L$ and the higher frequency $f_H$ are respectively the centre frequency of the lower frequency band $B_L$ (here $B_{Rx}$) and the centre frequency of the higher frequency band $B_H$ (here $B_{Tx}$).

The ratio r between the main focal length $F_M$ of the main reflector 204 and the equivalent focal length $F_{eq}$ of the dual-optics configuration of the antenna 202 is equal to the ratio between the lower frequency $f_L$ and the higher frequency $f_H$ and follows the same equation 1 as for the communication antenna 2 of the FIG. 1. Meanwhile, the equation 3 is also satisfied as long as the ratio r is expressed in terms of lower frequency $f_L$ and higher frequency $f_H$.

However, when the expression of the ratio is translated in terms of transmitting frequency $f_{Tx}$ and receiving frequency $f_{Rx}$, the ratio r is equal to $$\frac{f_{Rx}}{f_{Tx}}$$

for the antenna 202 of FIG. 9 (second embodiment), whereas the ratio r is equal to $$\frac{f_{Tx}}{f_{Rx}}$$

for the antenna 2 of FIG. 1 (first embodiment).

As for the design of FIG. 1, the design of the antenna 202 of FIGS. 10 and 11 leads to Cassegrain configurations having hyperbolic sub-reflectors that have unusually high eccentricity in respect of the conventional designs. The Frequency Selective Surface of the sub-reflector has an eccentricity e higher than 3, preferably ranging from 4 to 10, and more preferably ranging from 4 to 5.

The improvements of the communication antenna 202 in terms of mechanical manufacturing simplicity and achievable mechanical performance of the sub-reflector 206 are similar to the ones obtained with the communication antenna 2 of FIG. 1, since the shape of the obtained sub-reflector 206 is quite close to a flat surface while still being hyperbolic.

When the communication antenna 202 operates, the Frequency Selective Surface of the sub-reflector 206 reflects the lower frequency band, here the receiving Rx frequency band, of the received signals reflected by the main reflector 204 to the second receiving MFB system 210 while being transparent at the higher frequency band, here the transmitting Tx frequency band, to allow the transmission to the main reflector 204 of the transmitted signals generated by the first transmitting MFB system 208 located at the main focal point $F_{MO}$.

Like the communication antenna of FIGS. 1 and 2, the communication antenna requires a Frequency Selective Surface of a similar design with a band-pass or a high-pass filtering profile having a ratio of 1:1.3 between the highest reflected frequency (in the Rx band) and the lowest transmitted frequency (in the Tx band).

Figure 12:
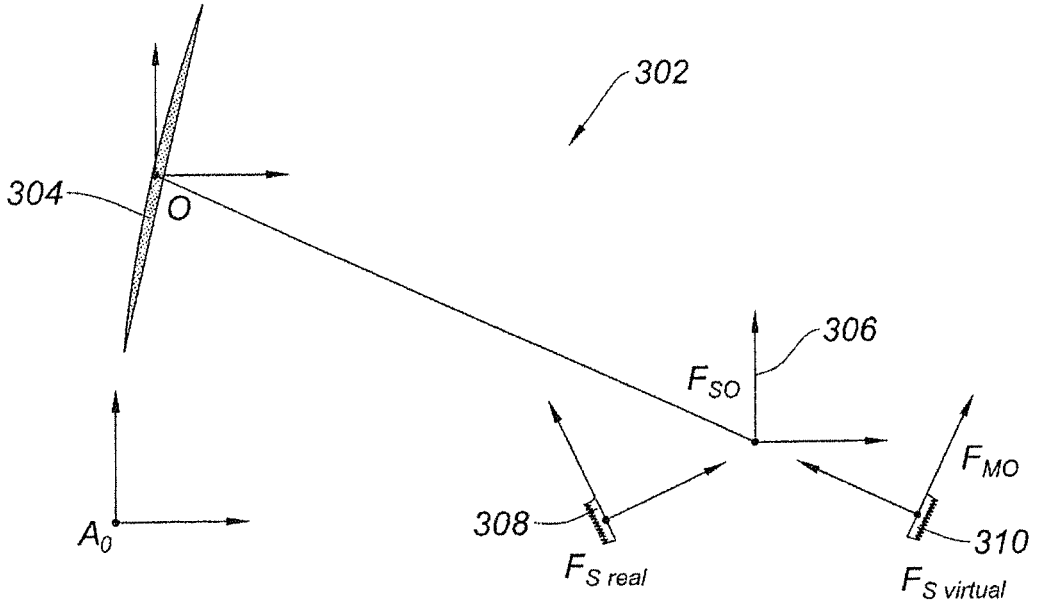
FIG. 12 is a view of a dual band satellite communication antenna according to a third embodiment of the invention.

According to the FIG. 12 and a third embodiment of the invention, a broadband communication satellite antenna 302, for producing a dual-band multiple beam coverage, made of a transmit multiple beam coverage operating in a first transmitting frequency band $B_{Tx}$ and of a receive multiple beam coverage operating in a second receiving frequency band $B_{Rx}$, is based on an offset dual-optics configuration.

Like the antennas 2 and 202, the first transmitting frequency band $B_{Tx}$ and the second receiving frequency band $B_{Rx}$ are separate or in other terms do not overlap. These bands are two separate sub-bands of a same third band, here the Ka-band. As a variant, the third band may be also L-band, S-band, C-band, X-band, Ku-band or Q/V-band.

The broadband communication satellite antenna 302 comprises a single main parabolic reflector 304, a flat sub-reflector 306, a first transmitting Multiple-Feed-per-Beam (MFB) feed system 308 configured to generate the first transmitting coverage and to illuminate the main reflector 304 through the sub-reflector 306, and a second receiving Multiple-Feed-per-Beam (MFB) feed system 310 configured to generate the second receiving coverage and to be illuminated by the sub-reflector 306.

Conversely to the communication antennas 2 and 202 the sub-reflector 305 is a Frequency Selective Surface (FSS) that has a flat shape. This configuration can be considered as a limit case of the first embodiment or the second embodiment where the eccentricity of the convex hyperbola is infinite.

In such a case the equivalent focal length of the dual-optics configuration and the main focal length of the main reflector are equal.

However this communication antenna 302 configuration is less attractive than the antennas 2, 202 configurations since the same focal length in transmitting and receiving frequency bands results in the same size of the Multiple-Feed-per-Beam (MFB) feed systems 308, 310 in the two bands, and since for a given beam spacing, the focal length and the minimum size of the feeds are set by the lowest frequency, this will result in a relatively large antenna system. Still, this configuration is of interest in comparison to the state-of-the-art as it provides a dual-band multiple beam coverage with only one aperture without compromising the RF performance.

More generally, a broadband communication satellite antenna according to the invention, encompassing the first, second and third embodiments, is configured to produce a dual-band multiple beam coverage made of a transmit multiple beam coverage operating in a first transmitting frequency band and a receive multiple beam coverage operating in a second receiving frequency band, the first transmitting frequency band and the second receiving frequency band being separate bands that do not overlap. The communication satellite antenna is based on an offset dual-optics configuration and comprises:

- a single main parabolic reflector having a main optical center, a main focal point and a main projected aperture diameter,
- a hyperbolic sub-reflector, with a finite eccentricity e higher than 3, that has a sub-reflector optical centre,
- a first transmitting Multiple-Feed-per-Beam feed system configured to generate the first transmit coverage and to illuminate the main reflector through the sub-reflector, and
- a second receiving Multiple-Feed-per-Beam feed system configured to generate the second receive coverage and to be illuminated by the main reflector through the sub-reflector.

The sub-reflector is a Frequency Selective Surface configured to transmit any electromagnetic signals in the higher frequency band among the first transmitting and the second receiving frequency bands, and to reflect any electromagnetic signals in the lower frequency band among the first transmitting and the second receiving frequency bands. The sub-reflector optical centre is located between and aligned with the main reflector optical centre and the main reflector focal point. The Multiple-Feed-per-Beam feed system among the first transmitting and second receiving Multiple-Feed-per-Beam feed systems that has a higher operating frequency band is located at the main focal point, while the remaining Multiple-Feed-per-Beam feed system is located on the reflecting side of the sub-reflector.

When the sub-reflector is hyperbolic, the eccentricity e depends on a ratio between a preset lower frequency $f_L$ in the lower frequency band $B_L$ and a preset higher frequency $f_H$ in the higher frequency band $B_H$, and is determined according to the implicit equation:

$$\frac{f_H}{f_L} = \frac{|e^2 - 1|}{(e^2 + 1) - 2e\cos\beta},$$

wherein β is a predetermined tilt angle between the axe of symmetry of the parabola defined by the main reflector and the axe of symmetry of the hyperbola defined by the sub-reflector.

The invention claimed is:

1. A broadband communication satellite antenna for producing a dual-band multiple beam coverage made of a transmit multiple beam coverage operating in a first transmitting frequency band $B_{Tx}$ and a receive multiple beam coverage operating in a second receiving frequency band $B_{Rx}$, the first transmitting frequency band $B_{Tx}$ and the second receiving frequency band $B_{Rx}$ not overlapping, the communication satellite antenna being based on an offset dual-optics configuration and comprising:

- a single main parabolic reflector having a main optical center O, a main focal point $F_{MO}$ and a main projected aperture diameter D,
- a sub-reflector, hyperbolic with a finite eccentricity e, that has a sub-reflector optical center $F_{SO}$, a first sub-reflector real focal point $F_{Sreal}$ and a second sub-reflector virtual focal point $F_{Svirtual}$,
- a first transmitting Multiple-Feed-per-Beam feed system configured to generate the first transmit coverage and to illuminate the main reflector through the sub-reflector, and
- a second receiving Multiple-Feed-per-Beam feed system configured to generate the second receive coverage and to be illuminated by main reflector through the sub-reflector, wherein

- the sub-reflector is a Frequency Selective Surface configured to transmit any electromagnetic signals in the higher frequency band $B_H$ among the first transmitting and the second receiving frequency bands, and to reflect any electromagnetic signals in the lower frequency band $B_L$ among the first transmitting and the second receiving frequency bands,
- the sub-reflector optical center $F_{SO}$ is located between and aligned with the main reflector optical center O and the main reflector focal point $F_{MO}$,
- the Multiple-Feed-per-Beam feed system among the first transmitting and second receiving Multiple-Feed-per-Beam feed systems that operates in the higher frequency band $B_H$ is located at the main focal point $F_{MO}$, while the remaining Multiple-Feed-per-Beam feed system that operates in the lower frequency band is located at the first sub-reflector real focal point $F_{Sreal}$;

the eccentricity e of the hyperbolic sub-reflector depends on a ratio between a preset lower frequency $f_L$ in the lower frequency band $B_L$ and a preset higher frequency $f_H$ in the higher frequency band $B_H$, and is determined according to the implicit equation:

$$\frac{f_H}{f_L} = \frac{|e^2 - 1|}{(e^2 + 1) - 2e\cos\beta},$$

where

β is a predetermined tilt angle between the axe of symmetry of the parabola defined by the main reflector and the axe of symmetry of the hyperbola defined by the sub-reflector; and the first transmitting Multiple-Feed-per-Beam feed system and the second receiving Multiple-Feed-per-Beam feed system are geometrical scaled versions of each other.

2. The broadband satellite antenna according to claim 1, having a Cassegrain dual-optic configuration, wherein the second sub-reflector virtual focal point $F_{Svirtual}$ and the main reflector focal point $F_{MO}$ coincide and the Multiple-Feed-per-Beam feed system among the first transmitting and second receiving Multiple-Feed-per-Beam feed systems that operates in the higher frequency band is located at the second sub-reflector virtual focal point $F_{Svirtual}$ that is confocal with the main reflector focal point.

3. The broadband satellite antenna according to claim 1, wherein the Frequency Selective Surface of the sub-reflector has an eccentricity e higher than 3.

4. The broadband satellite antenna according to claim 1, wherein the Frequency Selective Surface of the sub-reflector has an eccentricity e ranging from 4 to 10.

5. The broadband satellite antenna according to claim 1, wherein the Frequency Selective Surface of the sub-reflector has an eccentricity e ranging from 4 to 5.

6. The broadband satellite antenna according to claim 1, wherein the equivalent focal length $F_{eq}$ of the dual-optics configuration of the antenna is defined according to the equation:

$$F_{eq} = F_M \frac{|e^2 - 1|}{(e^2 + 1) - 2e\cos\beta}.$$

7. The broadband communication satellite antenna according to claim 1, wherein the tilt angle β is set to avoid the blockage effects between the main reflector and the sub-reflector, and also to comply with the Mizugutch condition providing low cross polarization.

8. The broadband communication satellite antenna according to claim 1, wherein the lower frequency $f_L$ and the higher frequency $f_H$ are respectively the center frequency of the lower frequency band $B_L$ and the center frequency of the higher frequency band $B_H$.

9. The broadband communication satellite antenna according to claim 1, wherein the second receiving Multiple-Feed-per-Beam feed system operates in the higher frequency band $B_H$ as the second receiving frequency band $B_{Rx}$ and is located at the second sub-reflector virtual focal point $F_{Svirtual}$, while the first transmitting Multiple-Feed-per-Beam feed system operates in the lower frequency band $B_L$ as the first transmitting frequency band $B_{Tx}$ and is located at the first sub-reflector real focal point $F_{Sreal}$.

10. The broadband communication satellite antenna according to claim 1, wherein the first transmitting Multiple-Feed-per-Beam feed system operates in the higher frequency band $B_H$ as the first transmitting frequency band $B_{Tx}$ and is located at the second sub-reflector virtual focal point $F_{Svirtual}$, while the second receiving Multiple-Feed-per-Beam feed system operates in the lower frequency band $B_L$ as the second receiving frequency band $B_{Rx}$ and is located at the first sub-reflector real focal point $F_{Sreal}$.

11. The broadband communication satellite antenna according claim 1, wherein the first transmitting frequency band and the second receiving frequency band are two separate sub-bands in Ka-band, the main parabolic reflector has a projected main aperture diameter of 2 m, a clearance of 0.5 m and a main focal length of 3 m, the first transmitting center frequency and the second receiving centre frequency are respectively equal to 18.95 and 28.75 GHz, the eccentricity e is equal to 4.4, and the β angle is equal to 20 degrees, the first transmitting feed system and the second receiving feed system are configured to generate a transmit multiple beam coverage and a receive multiple beam coverage, the transmit multiple beam coverage and the receive multiple beam coverage being composed respectively of 19 beams with a beam size of 0.5 de degrees, that are mutually congruent.

12. The broadband communication satellite antenna according to claim 1, wherein the first transmitting frequency band and the second receiving frequency band are two separate sub-bands of a same third band, the third band being comprised within the family of L-band, S-band, C-band, X-band, Ku-band, Ka-band and Q/V-band.

13. The broadband communication satellite antenna according to claim 1, wherein the number of beams is comprised between 10 and 60.

* * * * *